United States Patent [19]

Chandler

[11] Patent Number: 4,802,317

[45] Date of Patent: Feb. 7, 1989

[54] GROUND ANCHOR

[75] Inventor: David R. Chandler, Northglenn, Colo.

[73] Assignee: Foresight Industries, Inc., Northglenn, Colo.

[21] Appl. No.: 113,828

[22] Filed: Oct. 29, 1987

[51] Int. Cl.[4] ..... E02D 5/74

[52] U.S. Cl. ..... 52/163; 52/166

[58] Field of Search ..... 52/156, 162, 163, 165, 52/166

[56] References Cited

U.S. PATENT DOCUMENTS

| | | | |
|---|---|---|---|
| 768,705 | 8/1904 | Swan . | |
| 855,298 | 5/1907 | Frost . | |
| 936,824 | 10/1909 | Simpson et al. . | |
| 972,306 | 10/1910 | Wilcox . | |
| 1,014,806 | 1/1912 | Burns et al. . | |
| 1,052,700 | 2/1913 | Warrick . | |
| 1,564,069 | 12/1925 | Hoovens . | |
| 1,942,684 | 1/1934 | Chance | 52/166 |
| 3,653,167 | 4/1972 | Menard . | |
| 3,969,853 | 7/1976 | Deike . | |
| 3,969,854 | 7/1976 | Deike . | |
| 4,044,513 | 8/1977 | Deike . | |
| 4,096,673 | 6/1978 | Deike . | |
| 4,574,539 | 3/1986 | Deike . | |

OTHER PUBLICATIONS

Photographs of Prior Ground Anchor Marketed by Assignee Foresight Industries, Inc.

*Primary Examiner*—Carl D. Friedman
*Assistant Examiner*—Creighton Smith

[57] ABSTRACT

A plate or wing-type ground anchor for driving upright and into the ground to desired depth and pulled into flat anchoring position at the driven depth is provided with an extended cruciform shaped leg in advance of the plate wings to act as a star drill or chisel facilitating penetration of the ground. The plate anchor has an axial tubular body portion providing an elongated round bottom socket for mating with a round bottom drive rod for efficient transfer of impact energy from the rod to the anchor. A raised central rib on the tubular body portion has a sharp front cutting edge and a reduced thickness trailing end with a transverse hole therethrough. A pull member can include either a loop pivoted in the hole or a shackle straddling the reduced thickness end with a pin pivoted in the hole. Shoulders on the rib overlie the loop or shackle to divert earth therearound.

12 Claims, 2 Drawing Sheets

GROUND ANCHOR

BACKGROUND OF THE INVENTION

1. FIELD OF THE INVENTION

This invention relates to the art of plate or wing-type earth or ground anchors driven lengthwise into the ground and pulled when reaching an optimum depth to tilt into a flat transverse position for anchoring guy rods, cables or the like. Specifically the invention relates to rigid plate ground anchors with a longitudinal drive rod receiving socket having a round concave bottom for tiltable mating impact engagement with a round convex end of a drive rod, wings radiating from the socket, a star point chisel or drill leg leading end projecting forwardly from the wings, a raised longitudinally extending rib or ridge on the front face of the plate diverging from the trailing end of the leg to an eye hole with a sharp leading end and having recessed flat side faces straddled by a shackle or the looped end of a cable tiltable in the hole, a sharpened trailing end on the wings and socket and an extended curved lip on the socket to facilitate tilting of the anchor.

2. DESCRIPTION OF THE PRIOR ART

Heretofore known plate-type or wing-type ground anchors with drive rod sockets have had wide leading ends which are easily deflected when encountering hard ground layers or obstructions thereby causing the plate to tilt or cock relative to the driving rod. The sockets of such anchors have flat bottoms impacted by flat ends of the driving rods. Any cocking of the anchor from the on-line driving path not only increases the energy needed for advancing the anchor, but also misaligns the bottom of the socket with the driving end of the drive rod to minimize the area of contact causing an off center impact to further shift the anchor from its on-line driving course. The limited impact area soon causes the end of the drive rod to flatten or "mushroom" and bind in the socket preventing its withdrawal.

Further, the raised rib or ridge required for the eye hole of prior known plate or wing-type ground anchors has presented a wide blunt obstruction impeding piercing of the earth during the driving operation and further increasing the required driving energy.

It would therefore be an improvement in this art to avoid or minimize the above mentioned deficiencies of the prior known ground anchors.

Specifically it would be an improvement in this art to provide wing or plate-type ground anchors with axially extended chisel or star drill leading ends beyond the plate or wings to facilitate on-line driving of the anchor into the ground and to conserve driving energy.

It would be a further specific improvement in this art to provide round bottom sockets in ground anchors to be impacted by round-ended driving rods to insure full area impact zones and to maintain the anchor on the desired driving line.

A still further specific improvement in this art would be to provide the eye ridge of plate or wing-type socket equipped anchors with a sharp leading edge and recessed side faces at the eye hole to facilitate piercing of the ground and free swinging of a shackle or looped end of a cable in the eye hole.

SUMMARY OF THE INVENTION

According to this invention there is provided a rigid noncorrosive cast metal axial socket equipped plate or wing anchor capable of anchoring guy lines and the like for utility poles without yielding even under pull stress loads greater than heretofore handled without massive buried concrete anchor blocks. A preferred anchor of this invention is cast from a virtually indestructible aluminum/bronze alloy or ductile iron (preferably galvanized). While the anchors of this invention can be made in many different sizes, a very effective anchor for utility pole guy wires is about 14 inches long, 7 inches wide, and 3½ inches high at its tallest zone. Such a preferred sizing has a two inch long cruciform star point leg projecting axially forwardly from the wings. This cruciform leg has sharpened front edges and operates like a star drill to hold the anchor on its drive path even when encountering small rocks, shale, sandstone and the like. This elongated central axial star point penetrates hard layers and chips or breaks away obstructions before the wings of the plate encounter the hard layer in the soil. The chisel point action on the soil in advance of penetration by the wings or plate also decreases the driving energy required for advancing the anchor into the soil.

The leading ends of the wings are sharpened and tapered or inclined rearwardly. They are also tapered radially outward from the central socket body to thinner outer edges to further decrease earth resistance and aid in rapid penetration during the driving operation.

One pair of the cruciform sides or legs of the star point merge into the forward edges of the wings. The other pair of legs of the star point extend normal to the wings and merge rearwardly into the central axial socket defining portion of the anchor. A front or top face of the plate has a raised longitudinal ridge or rib diverging from the upright cruciform leg and sloping rearwardly to a higher level than the leg. The rear end of this ridge has a transverse eye hole therethrough and has flat sides normal to the wind behind radial shoulders of the ridge. These flat sides are straddled by either a shackle with a pin extended through the hole or the eye loop end of a cable. During the driving step the shackle or cable end is behind the shoulders and the sharpened front face of the rib or ridge plows the earth laterally away from the shackle or eye loop so that they do not form obstructions during the driving operation.

The U-shaped shackle has a threaded hole in its bight portion to receive a pull rod to tilt or rotate the anchor when it has reached its desired depth in the ground.

The trailing ends of the wing are also sharpened together with the rim around the open top of the socket. The socket has an extended lip portion beyond the wings and the rim of the socket and the lip are inclined and parallel with the sharpened edges of the wings. The lip portion is also outturned providing a curved tip diverging from the wings that will facilitate tilting of the anchor to its locking position when the pull rod or cable is tensioned.

The invention will be further understood from the showings in the drawings, forming a part of this specification, in which.

BRIEF DESCRIPTION OF THE PREFERRED ILLUSTRATED EMBODIMENTS

Figure 1:
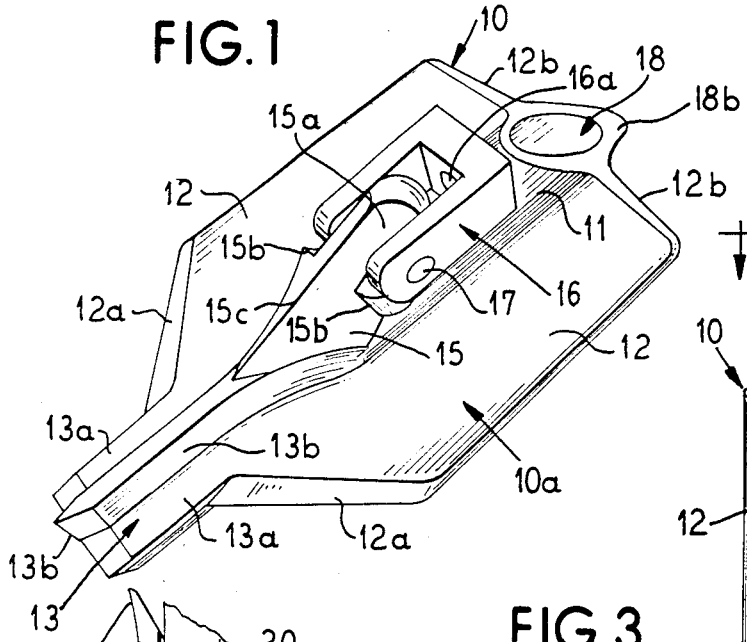
FIG. 1 is a top face and edge perspective view of a ground anchor of this invention.
Figure 2:
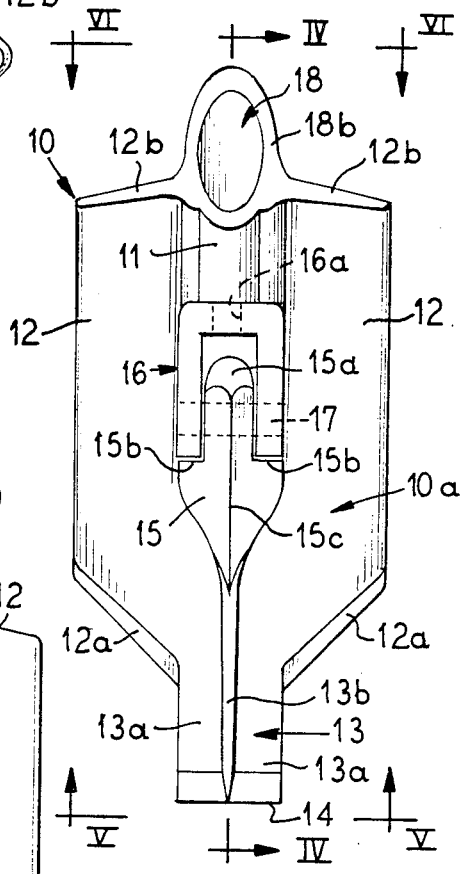
FIG. 2 is a front face view of the anchor of FIG. 1.
Figure 3:
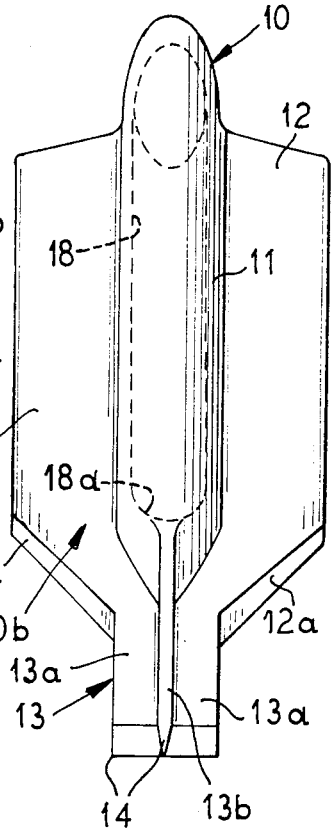
FIG. 3 is a back face view of the anchor of FIGS. 1 and 2.

In FIGS. 1–6 the reference numeral 10 designates generally a cast metal socket equipped plate or wing anchor of this invention with a front face 10*a* and a back face 10*b*. The anchor has a central longitudinal or axial tubular body 11 with wings 12,12 radiating from the body. These wings 12,12 are tapered from thicker portions adjacent the body to thinner outer edges.

The forward or leading end of the tubular body 11 has a projecting cruciform shaped leg 13. One pair 13*a*,13*a* of the cruciform sides of the leg 13 are in the same plane as the wings 12,12 and project forwardly from the sharpened front edges 12*a*,12*a* of the wings. These edges 12*a*,12*a* slope backwardly from the sides 13*a*,13*a* to the outer edges of the wings.

The other pair of sides 13*b*,13*b*, of the cruciform leg 13 are normal to the plane of the wings 12,12 and merge into the forward end of the tubular body portion 11.

The leading edges of the sides 13*a* and 13*b* are sharpened as illustrated at 14.

The side 13*b* of the leg 13 normal to the front face 10*a* of the anchor merges into an upright rib or ridge 15 extending axially of this front face and having an eye hole rear end portion 15*a* which is narrower than the leading end of the rib and has flat side faces extending beyond radial shoulders 15*b* of the rib. The eye portion 15*a* has a transverse hole therethrough and a U-shaped shackle 16 has side legs straddling the side faces of the eye portion 15*a* and a bight portion clearing this eye portion 15*a*. A pin 17 secured in the leg portions of the shackle 16 extends through the eye hole and tiltably supports the shackle on the anchor. The bight portion of the shackle has a threaded hole 16*a* therethrough to receive a pull rod as further hereinafter explained. The eye hole is positioned just rearwardly of the transverse center of mass of the anchor so that when the anchor is freely suspended on the pull rod its forward end will tilt downwardly at a slight angle from the horizontal. Then since most of the mass is forwardly of the pulling axis, the trailing end of the plate will swing downwardly about the leg 13 to a flatwise position.

The trailing ends of the wings 12,12 are also sharpened as illustrated at 12*b*,12*b* and the tubular body portion 11 extends rearwardly beyond the sharpened edges.

The tubular body 11 has a cylindrical socket 18 open at the rear end but having a round concave bottom 18*a* at a level above the leg 13. The socket has an open rear end defined by a rim 18*b* which is inclined upwardly and rearwardly from the front face 10*a* of the anchor to an outwardly and downwardly curved tip 19. The inclined rim is in the same plane as the sharpened trailing ends 12*b*,12*b* of the wings 12,12 and has its bottom portion extending forwardly from the sharpened ends with its top portion projecting beyond the sharpened ends. The degree of inclination of the lip 18*b* and the sharpened ends 12*b*,12*b* is about 45° from the front face of the anchor.

The rounded bottom 18*a* of the socket 18 is preferably fragmental spherical but any round convex shape accommodating free tilting movement of a round bottom driving tool is satisfactory.

Figure 4:
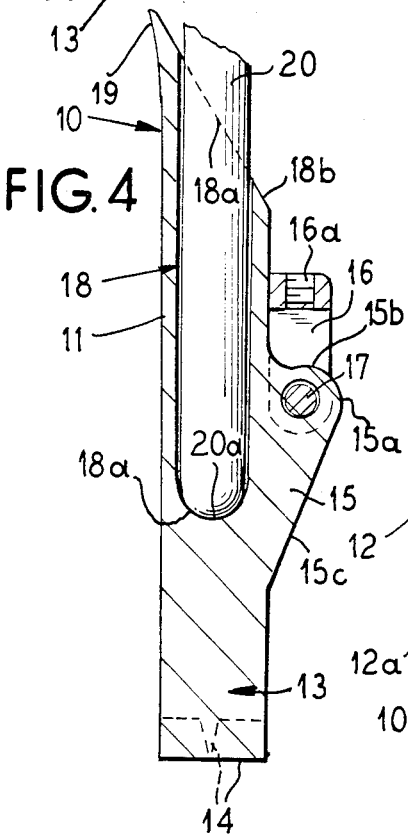
FIG. 4 is a central longitudinal cross-sectional view of the anchor taken along the line IV—IV of FIG. 2.
Figure 5:
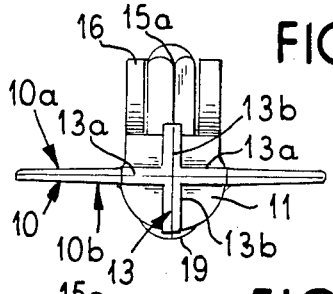
FIG. 5 is a leading edge elevational view of the anchor taken along the line V—V of FIG. 2.
Figure 6:
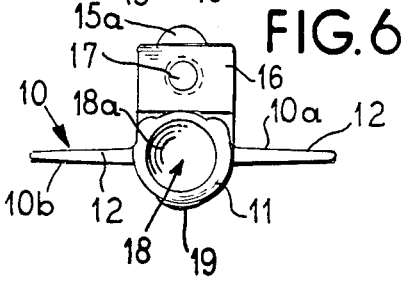
FIG. 6 is a trailing edge elevational view of the anchor taken along the line VI—VI of FIG. 2.

As shown in FIG. 4, the socket 18 receives a drive rod 20 in loose sliding fit relation. A slight clearance of about $\frac{1}{8}''$ is desired. The driving rod 20 has a convex, preferably hemispherical, driving end 20*a* mating with the concave bottom 18*a* to provide an extended area zone of contact between the drive rod and the bottom of the socket even when the clearance relationship of the drive rod and the socket accommodate a slight degree of cocking of the anchor relative to the drive rod.

The leading end portion of the rib 15 is also sharpened providing a cutting edge 15*c* to plow into the ground to divert the earth to the sides of the eye portion of the rib and the shackle pivoted in the eye.

Figure 7:
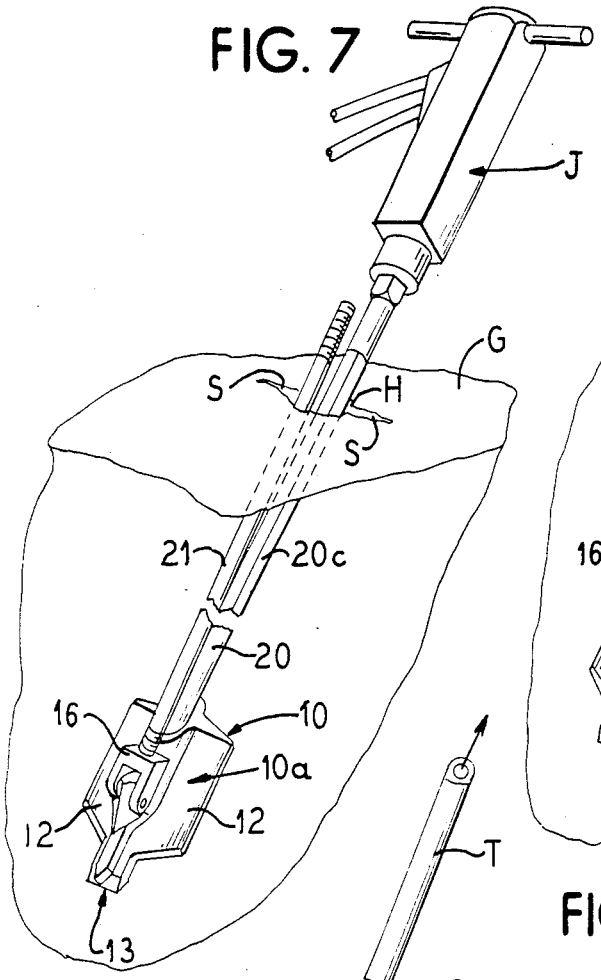
FIG. 7 is a front and side perspective view, with parts broken away, illustrating the manner in which the anchor is driven into the ground.

As shown in FIG. 7, the ground anchor 10 of this invention is easily and quickly driven into the ground G by a jackhammer J driving the drive rod 20 which, as shown on FIG. 4, has its leading end seated in the socket 18 with its rounded end 20*a* impacting the rounded bottom 18*a* of the socket. The drive rod 20 can have a hexagonal portion 20*c* above the cylindrical leading portion 20 for ease in connection to the jack J.

A pull rod 21 is threaded into the bight portion of the shackle 16.

In operation the pull rod 21 is positioned directly over the drive rod 20 and the front face 10*a* of the anchor 10 on this drive rod to address the ground G in an upright endwise position at a desired angle relative to the surface of the ground. Angles of from 30 to 90 degrees, depending on the desired angle for the guy rod or wire to be anchored, are used. As illustrated, the cruciform star point leg 13 of the anchor first enters the ground to chisel a somewhat round hole H which is then enlarged with slots S by the wings 12,12 as they enter the ground. The leg 13 with its four cruciform sides 13*a* and 13*b* each having sharpened leading edges 14 acts as a star drill or chisel to cut through the ground and any obstructions in the ground to facilitate entry of the wings into the ground. The drive rod 20 is sufficiently long to permit the jackhammer J to drive the anchor 10 to a desired depth in the ground. The pull rod 21 is sufficiently long to project above the ground level when the anchor 10 is driven to its desired depth in the ground. Since the entire driving operation maintains the anchor 10 in an upright position, the anchor acts as a cutting tool offering minimum resistance to the earth and preserving driving energy as it is impacted to its desired depth.

Figure 8:
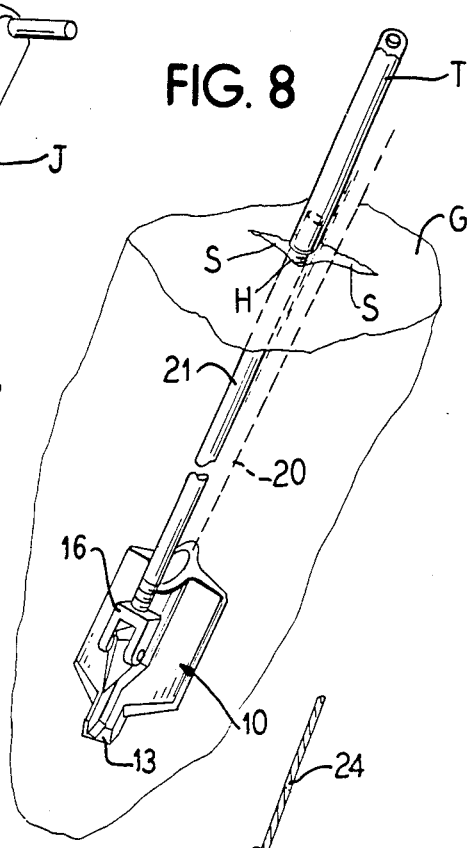
FIG. 8 is a view similar to FIG. 7, but illustrating the manner in which the pulling operation for setting the anchor is initiated.
Figure 9:
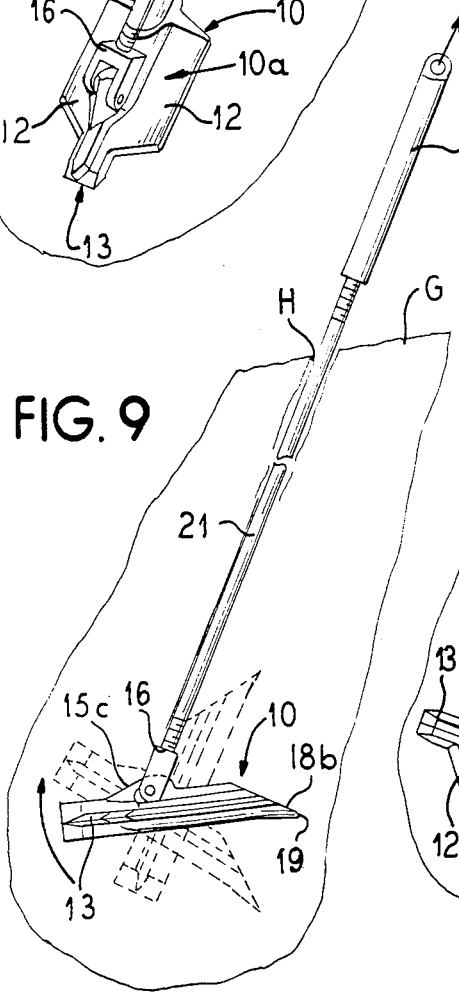
FIG. 9 is a view similar to FIG. 8, but taken 90 degrees therefrom to illustrate the manner in which the anchor is tilted or rotated during the pulling operation.

As illustrated in FIG. 8, when the anchor 10 has been driven into the ground to the desired depth, the drive rod 20 is pulled out of the socket and removed from the ground. Since the rounded end of the drive rod and the rounded bottom of the socket provide an extended impact area, the drive rod will not be deformed during the driving operation and is easily removed from the socket and pulled from the ground back through the round hole which the central portion of the anchor has formed. Then a pulling tool T, as shown in FIG. 8, is threaded on the upper end of the pull rod 21 and the rod 21 is pulled, as shown in FIG. 9, to tilt the anchor 10 about the leg 13 from its upright position to a transverse position in the ground. This tilting of the anchor 10 is facilitated by the placing of the eye hole rearwardly of the transverse center of mass of the anchor and the curved tip or lip 19 on the inclined rim 18*b* of the anchor. The hole H in the ground formed rearwardly of the leg lessens resistance to the tilting or rotation about the leg. During the pulling operation the shackle 16, of course, pivots in the eye hole and the sharpened leading and trailing edges of the wings together with the sharpened edge 15*c* of the ridge 15 ease displacement of the ground to facilitate the tilting.

Figure 10:
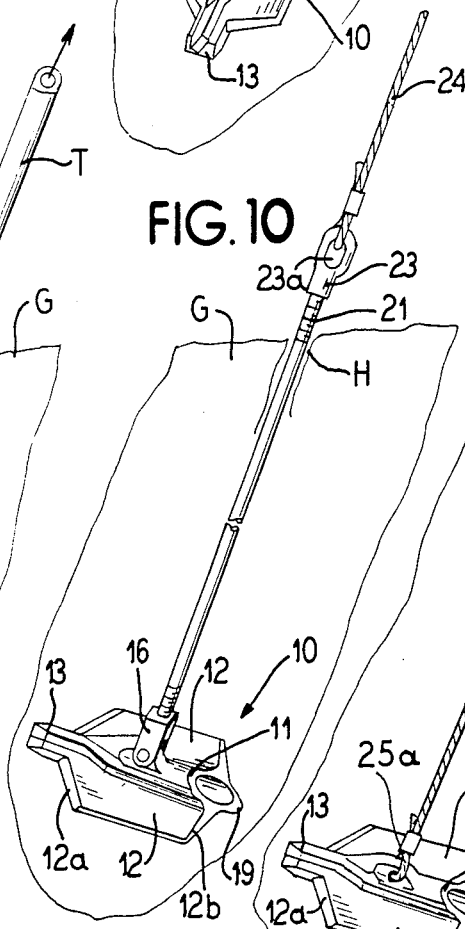
FIG. 10 is a view similar to FIG. 9 showing the anchor in its fully rotated or tilted locked position and illustrating the manner in which a cable or guy wire is attached to the pull rod.

When the anchor 10 has been pulled to its transverse or flat position in the ground, as shown in FIG. 10, the pulling tool T is removed from the pull rod 21 and a thimble 23 is threaded onto the upper end of the pull rod providing an eye hole 23*a* for receiving the eye end of a guy rod or guy wire 24. The other end of the guy rod or wire 24 is attached to a utility pole, a tree, or any upright structure to a anchored to the ground.

Figure 11:
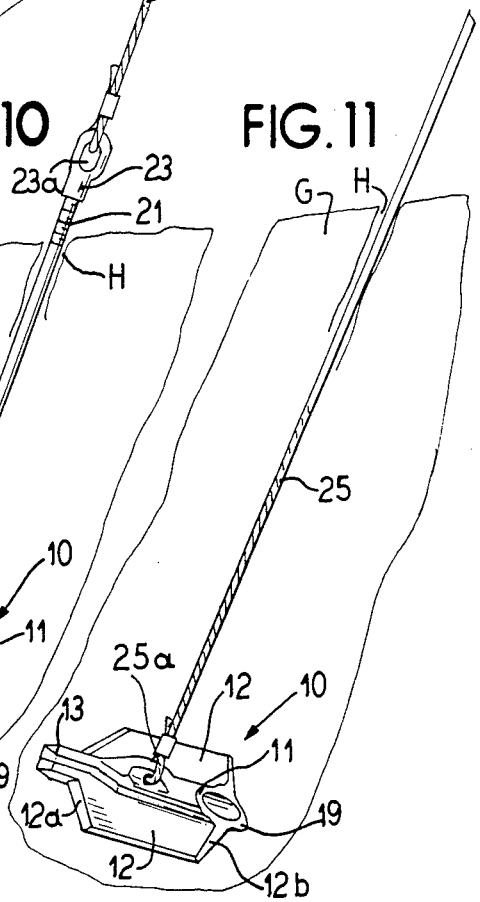
FIG. 11 is a view similar to FIG. 10, but illustrating the manner in which the eye end of the cable of guy wire can be attached directly to the anchor to eliminate the shackle.

FIG. 11 illustrates the manner in which a cable 25 can be used in place of the pull rod 21. In this arrangement the shackle 16 is not used and the cable 25 is provided with an eye end 25*a* extending through the hole of the eye in place of the pin 17. The eye end 25*a* of the cable will pivot in the eye hole in the same manner as the shackle 16 and the cable 25 can be pulled in the same manner as the pull rod 21 to set the anchor in the ground and to be attached to the pole or other structure to be anchored.

From the above descriptions it should therefore be understood that this invention improves the art of plate or wing-type ground anchors by facilitating insertion of the anchor into the ground and rotation of the anchor to is locked position in the ground. The anchors of this invention have extensive anchoring surfaces which when inserted upright or edgewise into the ground offer little resistance to ground penetration and rotation to a locking position when penetrated to the desired depth.

I claim as my invention:

1. A ground anchor which comprises a generally rectangular rigid plate member having a tubular longitudinal central body portion, wings radiating laterally from the body portion along the length thereof, a central axial leg portion projecting from the body portion forwardly of the wings and having radiating sides with sharpened leading edges forwardly of the wings, said body portion having a raised longitudinal rib diverging rearwardly from the leg portion to an eye portion, said rib having a sharpened leading edge effective to plow earth to the sides of the body portion, said eye portion of the rib having radial shoulders in advance of the eye, a pull member pivotably mounted in the eye behind said shoulders, said tubular body portion having a socket along the length thereof with a round bottom adapted to receive a drive rod for driving the anchor into the ground, said socket having an open top with an inclined rim projecting rearwardly from the trailing ends of the wings, and said rim and said trailing and leading ends of the wings being sharp to facilitate rotation of the anchor in the ground.

2. The ground anchor of claim 1 wherein said pull member includes a U-shaped shackle with legs straddling the rib portion behind the shoulders and a bight portion overlying the rib, a pivot pin extending through the eye portion secured to the legs of the shackle, and a threaded hole in the bight portion of the shackle.

3. The ground anchor of claim 1 wherein the sides of the central axial leg portion include a pair of sides in the plane of the wings and a second pair of sides normal to said plane.

4. The ground anchor of claim 1 wherein the radiating sides of the central axial leg portion are arranged in cruciform relation to provide a star drill for piercing the ground.

5. The ground anchor of claim 1 wherein the inclined rim of the open top of the socket has a rearwardly curved tip facilitating rotation of the anchor in the ground.

6. The ground anchor of claim 1 including a drive rod with a round bottom tiltably mating with the round bottom of the socket.

7. The ground anchor of claim 1 wherein the inclined rim has a curved lip facilitating rotation of the anchor in the ground.

8. A wing-type ground anchor which comprises a rigid plate having a central longitudinal tubular body portion, wings radiating from the body portion along the length thereof, a cruciform shaped leg on the body portion extending forwardly from the wings, a raised rib with an eye hole therethrough on the body portion merged into one of the sides of the cruciform shaped leg, a shackle straddling said rib, a pin pivotably mounting said shackle in the eye hole of the rib, said body portion having a longitudinal rocket along the length thereof with a rounded bottom and an open top, and said open top having an inclined rim projecting behind the trailing ends of the wings.

9. The ground anchor of claim 2 wherein the wings have sharpened leading edges diverging rearwardly from the tubular body portion.

10. The ground anchor of claim 2 wherein the rigid plate is a cast noncorroding metal alloy.

11. The ground anchor of claim 2 including a drive rod freely fitting said socket and having a rounded bottom mating with the rounded bottom of the socket.

12. A plate type ground anchor to be driven edgewise into the ground and rotated in the ground to a flatwise anchoring position which comprises a rigid plate having an axial tubular body portion with an open top and closed bottom, a leg projecting forwardly from said body portion, a pair of wings radiating laterally from said body portion along the length thereof having leading edges rearwardly of the leg and trailing edges at the open top of the body portion, a raised axial rib on the body portion diverging from the leg to a trailing end forwardly of the open top, a transverse hole through said trailing end of the rib for receiving a pull member to rotate the plate to its flatwise position in the ground and said raised axial rib on the body portion having a sharp leading edge and outwardly inclined sides for plowing earth to the sides of the rib.

* * * * *